United States Patent [19]

Ikemi et al.

[11] 4,197,727

[45] Apr. 15, 1980

[54] METHOD OF CONTROLLING A SHAPE OF A ROLLED SHEET

[75] Inventors: Shinichi Ikemi, Amagasaki; Michio Shimoda, Kobe, both of Japan

[73] Assignee: Mitsubishi Denki Kabushiki Kaisha, Tokyo, Japan

[21] Appl. No.: 958,394

[22] Filed: Nov. 7, 1978

[30] Foreign Application Priority Data

Nov. 9, 1977 [JP] Japan ..... 52/134916

[51] Int. Cl.[2] ..... B21B 37/06

[52] U.S. Cl. ..... 72/12

[58] Field of Search ..... 72/6–12, 72/16, 17

[56] References Cited

U.S. PATENT DOCUMENTS

| | | | |
|---|---|---|---|
| 3,731,508 | 5/1973 | Sabatini et al. | 72/9 |
| 3,934,438 | 1/1976 | Arimura et al. | 72/9 |

OTHER PUBLICATIONS

"ASEA-ALCAN AFC System . . .", Sivilotti et al., Iron and Steel Engr., Jun. 1973, pp. 83–90.

"Design & Development of a Shape Control System", Bravington et al., Met. Soc., 183, 1976, pp. 82–88.

"Operation of Experience . . .", Van Haperen et al., Met. Soc., 1976, 183, pp. 63–70.

*Primary Examiner*—Milton S. Mehr

*Attorney, Agent, or Firm*—Oblon, Fisher, Spivak, McClelland & Maier

[57] ABSTRACT

In a tandem type rolling mill, it is difficult to control each roll bending force so as to produce a constant forward slip and a constant backward slip at each stand in the transversal direction.

A first shape meter is disposed between a pay-off reel and a first stand and a second shape meter is disposed between a tension reel and a last stand. The roll bending forces under the first stand, the second stand, . . . the lth stand are controlled so as to produce a constant backward slip at the first stand as measured by the shape meter disposed between the pay-off reel and the first stand to provide a predetermined value.

The roll bending forces under the first stand, the second stand, . . . the lth stand are also controlled so as to provide a constant forward slip at the last stand as measured by the shape meter disposed between the last stand and the tension reel to provide a predetermined value.

The feeding of a roll coolant is also controlled together with the control of roll bending forces.

2 Claims, 22 Drawing Figures

FIG. 1A
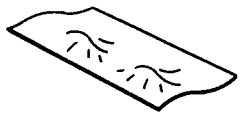
FIG. 1B
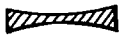
FIG. 1C
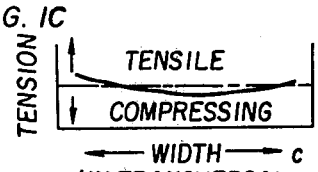
FIG. 1D
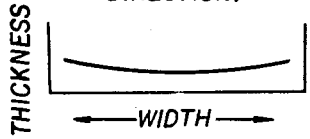
FIG. 2A
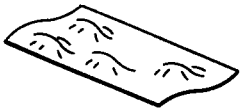
FIG. 2B
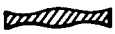
FIG. 2C
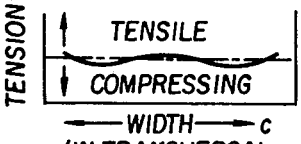
FIG. 2D
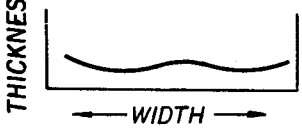
FIG. 3A
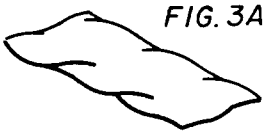
FIG. 3B
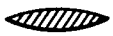
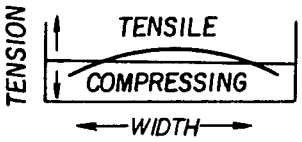
FIG. 3C
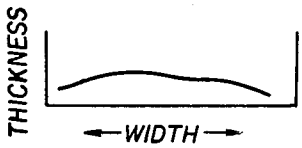
FIG. 3D

METHOD OF CONTROLLING A SHAPE OF A ROLLED SHEET

BACKGROUND OF THE INVENTION

The present invention relates to a method of controlling the shape of a rolled sheet in a tandem type rolling mill.

Usually a rolled sheet, especially a thin sheet, is prepared by rolling it in a rolling mill. In this method, the sheet is rolled to elongate it in the longitudinal direction so as to form a thinner sheet.

The elongation is dependent upon the ratio of draft [(sheet thickness at input side—sheet thickness at output side)/(sheet thickness at input side)]. The distribution of the elongation in the transversal direction is dependent upon the distribution of the sheet thickness at the input side in the transversal direction and the distribution of the sheet thickness in the transversal direction after the rolling.

The distribution of the sheet thickness after the rolling is affected by the deformation of the rolling rolls such as:

1. an elastic deformation of the rolling roll;
2. a thermal expansion of the rolling roll caused by conducting heat from the rolled sheet to the rolling rolls; and
3. a wear of the rolling rolls caused by friction between the rolled sheet and the rolling roll.

The distribution of the elongation in the transversal direction is caused by the elongation of the rolled sheet in the longitudinal direction wherein compressing stresses and tensile stresses in the longitudinal direction remain as the distribution in the transversal direction. When the stresses are higher than certain limits, deformation of the rolled sheet is produced resulting in a backing phenomenon which is called a shape defect.

FIGS. 1, 2, and 3 show the relationship between the distribution of the sheet thickness after the rolling and the shape defect of the rolled sheet caused by the distribution of the sheet thickness for the case of a constant sheet thickness at the input side.

In FIGS. 1 (A), (B), (C), FIGS. 1, 2, and 3, FIGS. 1A, 2A, and 3A show a schematic view of a rolled sheet having shape defect; FIGS. 1B, 2B, and 3B show a sectional view of the rolled sheet in the transversal direction; FIGS. 1C, 2C, and 3C show a tension distribution of the rolled sheet in the transversal direction; and FIGS. 1D, 2D, and 3D a distribution of the rolled sheet in the transversal direction.

The shape defect shown in FIG. 1 is called a middle elongation or a center backing.

The condition shown in FIG. 2 is called a lug wave or a wave edge. This shape defect causes a failure of the apparatus or a deterioration of quality in the later steps.

Heretofore, in order to prevent such shape defects in the rolled sheet, the roll bending force under the last stand has been controlled. That is, in the conventional shape controlling method, it has been considered to be optimum to provide uniform front tension at the last stand. However, in the tandem type rolling mill, the uniformity of the draft distribution at the first stand in the transversal direction is usually difficult to maintain in that the distribution of the speed at the output side of the first stand is not uniform and has a certain distribution in the transversal direction. Thus, the backward slip at the first stand (provided one does not consider the back tension at the first stand) in the transversal direction is not uniform and is varied depending upon the shape of the sheet and the distribution of the sheet thickness at the input side of the first stand.

In order to produce a uniform distribution of the backward slip, it is necessary to produce a certain tension distribution between the pay-off reel and the first stand. Accordingly, even though a uniform front tension at the last stand is supplied, it has been impossible to produce a desired shape of the rolled sheet because of the back tension distribution at the first stand.

SUMMARY OF THE INVENTION

The present invention overcomes the above-mentioned disadvantages and provides a method of controlling the shape of a rolled sheet and provides an apparatus for controlling the shape of a rolled sheet with high accuracy.

The present invention which provides a method for controlling the shape of a rolled sheet comprises detecting the tension distribution of the sheet between a pay-off reel and a first stand; comparing the detected tension distribution with a desired pattern of a tension distribution; controlling the roll bending force under the first stand and/or a second stand, or controlling the distribution of a roll coolant at the first stand depending upon said comparison of tension distributions; detecting the tension distribution between a last stand and a tension reel; comparing the detected tension distribution with a desired pattern of a tension distribution; and controlling the roll bending force under the last stand or under an $(N-1)$th stand, or controlling the distribution of a roll coolant at the last stand; whereby a shape defect at the output side caused by a shape defect, such as middle elongation of the sheet thickness at the input side can be corrected to obtain a rolled sheet having high shape accuracy.

BRIEF DESCRIPTION OF THE DRAWINGS

FIG. 1A is a schematic illustration of a shape defect in a rolled sheet;

FIG. 1B is a profile view of the shape defect shown in FIG. 1A;

FIGS. 1C and 1D are graphs showing tension and thickness distributions in a rolled sheet having a shape defect as shown in FIG. 1A;

FIG. 2A is a schematic illustration of a second shape defect in a rolled sheet;

FIG. 2B is a profile view of the shape defect shown in FIG. 2A;

FIGS. 2C and 2D are graphs showing tension and thickness distributions in a rolled sheet having a shape defect as shown in FIG. 2A;

FIG. 3A is a schematic illustration of a third shape defect in a rolled sheet;

FIG. 3B is a profile view of the shape defect shown in FIG. 3A;

FIGS. 3C and 3D are graphs showing tension and thickness distributions in a rolled sheet having a shape defect as shown in FIG. 3A;

DETAILED DESCRIPTION OF THE PREFERRED EMBODIMENTS

Figure 4:
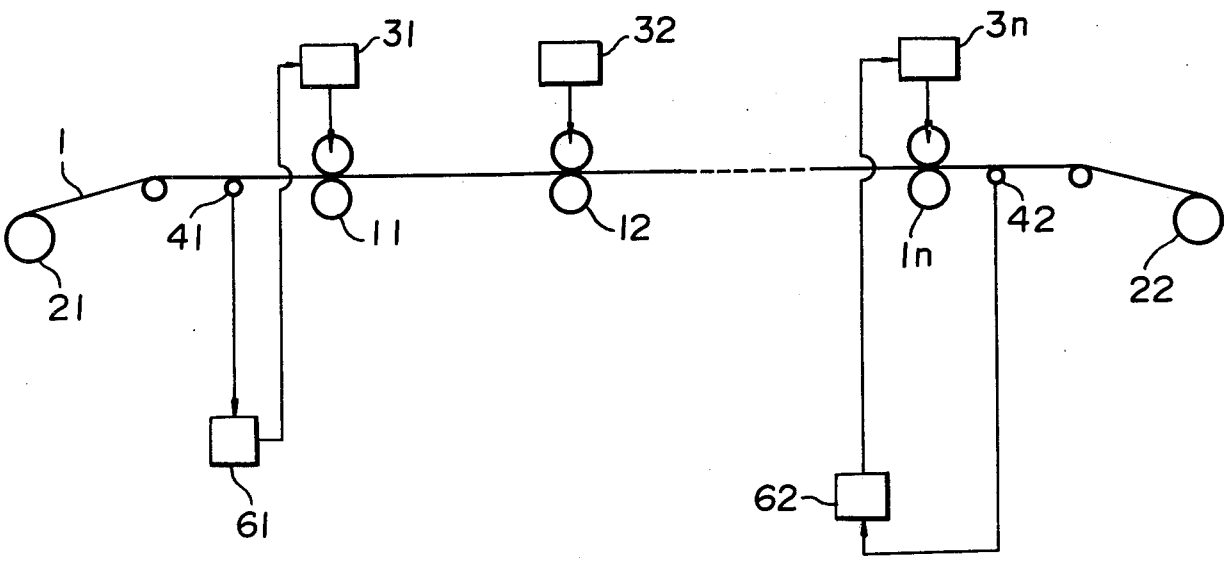
FIG. 4 is a block diagram which illustrates one embodiment of the present invention for controlling the shape of a rolled sheet.

FIG. 4 is a block diagram of one embodiment of the present invention wherein the reference numeral (1) designates a sheet; (11), (12) . . . **(1*n*) designates rolling rolls; (21) designates a pay-off reel; (22) designates a tension reel; (31), (32) . . . (3*n*) designate roll bending force controlling devices; (41) and (42) designate shape meters for detecting each distribution of tensions in the transversal direction; (61) designates an arithmetic unit for the first roll bending force which calculates the difference between the tension distribution detected by the shape meter (41) and a desired tension distribution to obtain the required roll bending force under the first stand; (62) designates an arithmetic unit for the second roll bending force which calculates the difference between the tension distribution detected by the shape meter (42)** and a desired tension distribution to obtain the required roll bending force under the last stand.

The relationship of the forward slip, the backward slip, and the back tension under the principles of the present invention will be illustrated for the case where a flat sheet is fed from the output of the pay-off reel and the draft distribution at the first stand is in transversal direction.

The forward slip distribution $f_1(x)$ at the first stand is given by:

$$f_1(x)=g(\gamma 1(x),R_1(x),hi_1(x),\mu_1) \quad (1)$$

wherein:

$\gamma_1(x)$: draft distribution in transversal direction;

$R_1(x)$: roll radius distribution in transversal direction;

$hi_1(x)$: sheet thickness distribution at the input side in transversal direction $\mu 1$: friction coefficient x: distance from side edge of sheet When the roll radius distribution and the sheet thickness distribution in the input side are constant but the draft distribution is not constant, the forward slip $f_1(x)$ provides a distribution given by equation (1).

The backward slip distribution $\lambda_1(x)$ at the first stand is given by:

$$\lambda_1(x) = \frac{ho_1(x)}{hi_1(x)}(1 + f_1(x)) - 1 \quad (2)$$

wherein $ho_1(x)$: sheet thickness at the output side.

The backward slip distribution is not constant; that is, a certain back tension is produced between the pay-off reel and the first stand. This back tension is dependent upon the backward slip distribution. The forward slip distribution produces a mass flow at the input and output of the first stand. Where there is a sheet thickness distribution at the output side, the speed at the output side of the first stand has a certain distribution.

The above-mentioned discription is summarized as follows: It is not sufficient even though the shape of the sheet is uniform on the pay-off reel. If the draft distribution under the first stand is different, the tension between the pay-off reel and the first stand will have a certain distribution; and moreover, the speed at the output of the first stand will have a certain distribution. The speed distribution of the sheet fed into the last stand in the transversal direction is dependent upon the first stand, the second stand, . . . , and the (n−1)th stand; and with regard to the shape of the rolled sheet the input speed at the last stand is dependent upon the draft distribution at the first stand. That is, the sheet thickness at the output side of the second stand is dependent upon the sheet thickness at the output side and upon the output speed at the first stand. The sheet thickness at the output side of the third stand is dependent upon the sheet thickness at the output side and upon the output speed at the second stand. Accordingly, the sheet thickness at the input side and the input speed at the last stand are dependent upon the draft at the first stand and this it is unnecessary to consider the draft distribution from the second stand to the (n−1)th stand.

Therefore, in order to obtain a desired shape of the rolled sheet, the distribution of the back tension at the first stand should have a desired pattern and the distribution of the front tension at the last stand should have a desired pattern.

Figure 5A:
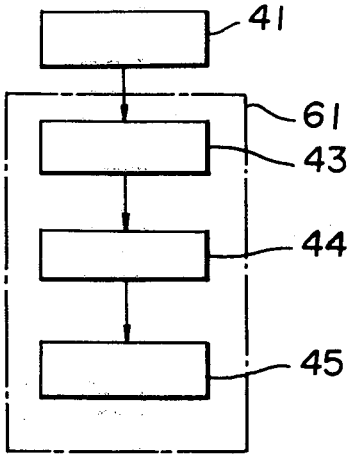
FIGS. 5A and 5B are block diagrams which illustrate the operation of the major portions of the embodiment of the present invention shown in FIG. 4.
Figure 5B:
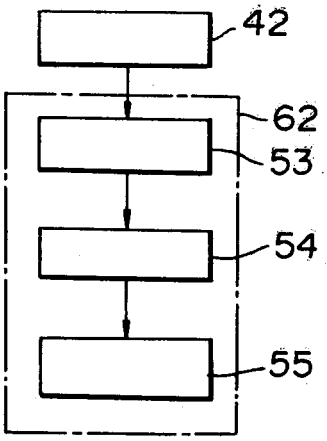

Referring to FIG. 5, the present invention will be further illustrated with regard to the operation of the first and second roll bending force arithmetic units (61) and (71) shown in FIG. 4. FIG. 5(A) shows a method of controlling between the pay-off reel and the first stand. FIG. 5(B) shows a method of controlling between the last stand and the tension reel.

The method shown in FIG. 5(A) will be illustrated as follows:

The tension distribution between pay-off reel (21) and the first stand (11) is detected by the shape meter (41). In the part (43), the detected tension distribution is compared with a desired pattern of tension distribution to obtain the difference between them. In part (44), a calibration for the draft distribution at the first stand is determined from the calculated value. In part (45), the optimum roll bending force under the first stand is calculated from the calculated value. The roll bending force controller (31) controls the roll bending force depending upon the calculated optimum roll bending force.

The method shown in FIG. 5(B) will be illustrated as follows:

The tension distribution between the last stand and the tension reel is detected by the shape meter (42). In part (53), the detected tension distribution is compared with a desired pattern of tension distribution to obtain the difference between them. In part (54), the calibration of the draft at the last stand is calculated from upon the calculated value. In part (55), the optimum roll bending force under the last stand is determined from the calculated value. The calculated value forms the input to the roll bending force controller **(3*n*)** which controls the roll bending force. Thus, a rolled sheet having a desired shape can be obtained by said method.

The desired pattern of the tension distribution will be illustrated for a simple shape as follows:

When a transversal sectional view of the sheet (1) between the pay-off reel (21) and the first stand (11) is flat, the transversal sectional view of the rolled sheet in the output side of the first stand can be flat by provided that the tension distribution detected by the shape meter (41) is flat.

When the transversal sectional view of a sheet fed under the first stand is not flat, the roll bending force is controlled to produce a desired pattern of the tension distribution for calibrating the sectional view. Moreover, the roll bending force under the last stand (3*n*) is controlled to provide a desired pattern (flat) of the tension distribution between the last stand (3*n*) and the tension reel (22).

The consideration of the operation will be further illustrated by referring to FIGS. 6A through 6E.

Figure 6A:
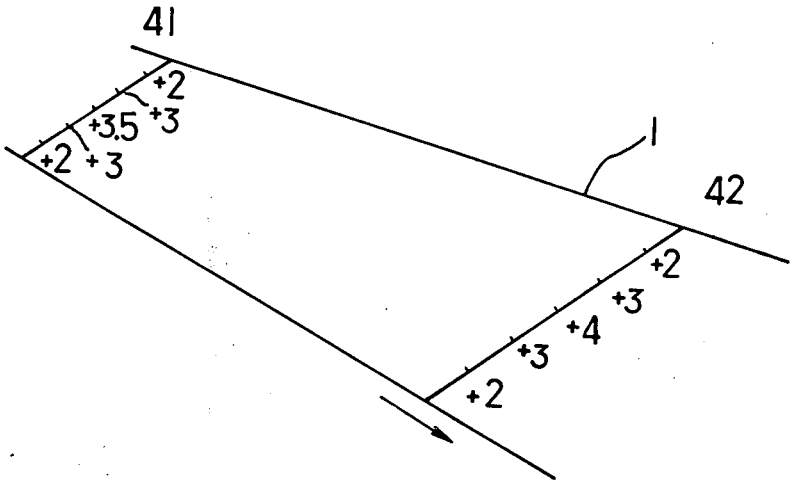
FIG. 6A is a schematic illustration of the tension distributions at two locations in the rolled sheet.
Figure 6B:
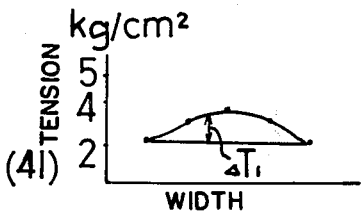
FIGS. 6B and 6C are graphs illustrating the tension distributions shown in the rolled sheet of FIG. 6A.
Figure 6D:
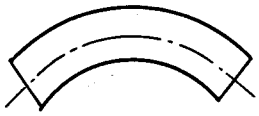
FIG. 6D is a schematic view of the roll shape of the sheet shown in FIG. 6A.
Figure 6C:
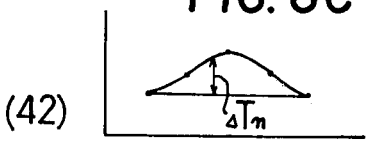

When the tension distribution in the transversal direction is as shown in FIG. 6A, the tension distributions detected by the shape meters (41), (42) are as shown in FIGS. 6C, D and E. The arithmetic units (61) and (62) operate to determine the tension distributions of FIGS. 6B and 6C, and the roll bending force arithmetic unit operates to provide the standard tension distribution, for example, the flat tension distribution. The roll shape of the work is given as shown in FIG. 6D. As a further illustration, the output side tension distribution $T_n$ detected by the shape meter (42) and the input side tension distribution $T_I$ detected by the shape meter (41) are given by the equations:

$$T_n=(a_nx^2+b_nx+c_n)+A_{n-1}(a_{n-1}x^2+b_{n-1}x+c_{n-1})R_{n-1}+\ldots+A_I(a_Ix^2+b_Ix+c_I)R_I \quad (3)$$

$$T_I=(a_1x^2+b_1x+c_1)R_1+A_2(a_2x^2+b_2x+c_2)R_2+\ldots A_{I-1}(a_{I-1}x^2+b_{I-1}x+c_{I-1})R_{I-1} \quad (4)$$

wherein: a, b, c: constant coefficients; A: functional coefficients; R: roll bending force; x: distance in the transversal direction; n: last stand number; I: stand number in 1-n stands.

Figure 6E:
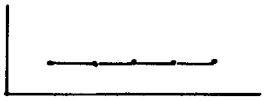
FIG. 6E is a graph of the standard tension distribution for the sheet shown in FIG. 6A.

The roll bending forces under the stands are controlled to provide R in the equations (3) and (4) by inserting the tensions for calibration $\Delta T_I$ and $\Delta T_n$ in FIGS. 6B and 6C. (Thus, it is usual to control two or three stands.) The sum of the tension distributions detected by the shape meters (41) and (42) becomes the standard tension distribution as shown in FIG. 6E.

When a shape defect of a rolled sheet is caused by rolling under the second to (N-1)th stands, it is found as a defect of tensions in the shape meters (41) and (42). The surface shape of the rolled sheet can be excellent by controlling the roll bending forces depending upon the data of the shape meter (41) in front of the first stand (31) and the shape meter (42) after the last stand (3*n*).

Figure 7:
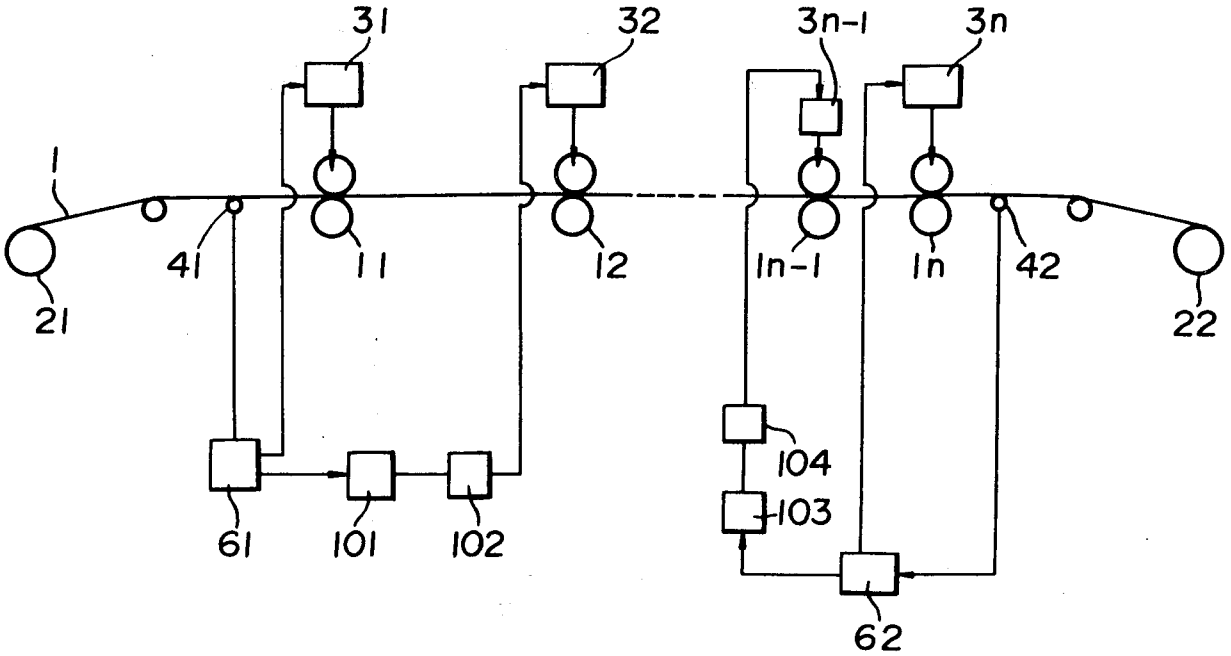
FIGS. 7 and 8 are block diagrams which illustrate other embodiments of the present invention.
Figure 8:
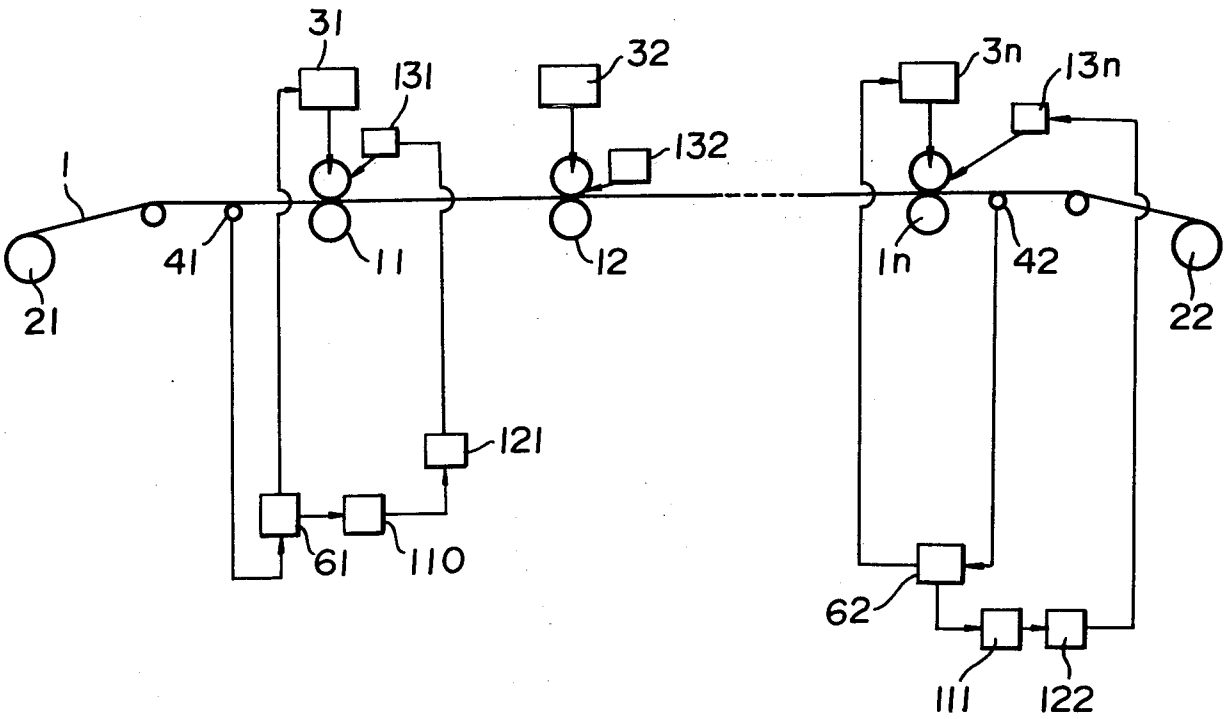

FIGS. 7 and 8 show block diagrams of the other embodiments of the method of controlling the rolled sheet according to the present invention.

In FIG. 7, the reference numeral (101) designates a discriminator which determines whether a desired tension distribution can be obtained by the roll bending force under the first stand calculated by controlling the arithmetic unit (61). Reference numeral (102) designates an arithmetic unit for operating the roll bending force under the second stand when the discriminator shows that the desired pattern can not be obtained by only controlling the roll bending force under the first stand. The reference numeral (103) designates a discriminator which determines whether a desired tension distribution can be obtained by controlling the roll bending force under the last stand calculated by the arithmetic unit (62). Reference numeral (104) designates an arithmetic unit for operating the roll bending force under the (N−1)th stand when the discriminator shows that the desired pattern can not be obtained by only controlling the roll bending force under the last stand. It is possible to operate roll bending forces under the third stand and the fourth stand and to control these roll bending forces under these stands and also under the last stand.

In FIG. 8, the reference numeral (119) designates a discriminator which determines whether a desired pattern of the tension distribution can be produced by controlling the roll bending force under the first stand. Reference numeral (121) designates an arithmetic unit which calculates a controlled amount of a roll coolant to be supplied when an amount of the roll coolant on the first stand is controlled as the result of the determination of the discriminator (110).

The reference numeral (111) designates a discriminator which determines whether a desired pattern of the tension distribution can be produced by controlling the roll bending force under the last stand. Reference numeral (122) designates an arithmetic unit which calculates a controlled amount of a roll coolant to be supplied when an amount of the roll coolant on the last stand is controlled as the result of the determination of the discriminator (111).

It is possible to improve the shape of the rolled sheet by combining the features of FIGS. 7 and 8.

We claim:

1. A method of controlling a shape of a rolled sheet in a tandem type roll mill, which comprises disposing first and second shape meters for detecting each tension distribution in the transversal direction of the rolled sheet between a pay-off reel and a first stand and between a last stand and a tension reel; controlling a roll bending force or a distribution of a roll coolant for each of the first to the lth stands so as to give a desired pattern of a tension distribution detected by the first shape meter which gives a constant forward slip and a constant backward slip in the transversal direction of the rolled sheet; and controlling a roll bending force or a distribution of a roll coolant for each of the m th to the last stands so as to give a desired pattern of a tension distribution detected by the second shape meter which gives a constant forward slip and a constant backward slip in the transversal direction of the rolled sheet wherein the reference l and m respectively are intermediate stands.

2. A method of controlling a shape of a rolled sheet according to claim 1 wherein the roll bending forces or distributions of the roll coolant at the first to l th stands and at the m th to last stands are controlled to give flat tension distributions detected by the first and second shape meters.

* * * * *